US010766050B2

(12) United States Patent
Nakagaki et al.

(10) Patent No.: US 10,766,050 B2
(45) Date of Patent: Sep. 8, 2020

(54) COATING APPARATUS AND IMAGE FORMING SYSTEM

(71) Applicants: Toshihiro Nakagaki, Kanagawa (JP); Kenji Nozawa, Kanagawa (JP)

(72) Inventors: Toshihiro Nakagaki, Kanagawa (JP); Kenji Nozawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/294,447

(22) Filed: Mar. 6, 2019

(65) Prior Publication Data

US 2019/0283069 A1 Sep. 19, 2019

(30) Foreign Application Priority Data

Mar. 16, 2018 (JP) ..... 2018-049099

(51) Int. Cl.
*B05C 1/08* (2006.01)
*B41J 11/00* (2006.01)
*B41M 5/00* (2006.01)

(52) U.S. Cl.
CPC ..... *B05C 1/083* (2013.01); *B41J 11/006* (2013.01); *B41J 11/0015* (2013.01); *B41M 5/0017* (2013.01)

(58) Field of Classification Search
CPC ..... B05C 1/083; B41J 11/006; B41J 11/0015; B41M 5/0017
USPC ..... 347/101
See application file for complete search history.

(56) References Cited

U.S. PATENT DOCUMENTS

2012/0074638 A1 3/2012 Nakagaki
2012/0249627 A1* 10/2012 Komaba ..... B41J 2/17566 347/6
2013/0070017 A1* 3/2013 Fujii ..... B41J 2/14274 347/20
2013/0241146 A1 9/2013 Takai et al.
2013/0320616 A1 12/2013 Nakagaki
2014/0327207 A1 11/2014 Nakagaki
2016/0114993 A1 4/2016 Nakagaki
2016/0152431 A1 6/2016 Maeda et al.
2016/0190329 A1 6/2016 Matsumoto et al.
2016/0267873 A1 9/2016 Saotome et al.
(Continued)

FOREIGN PATENT DOCUMENTS

JP 2002-137378 5/2002
JP 2012-240778 12/2012
JP 2013-022874 2/2013
(Continued)

*Primary Examiner* — Huan H Tran
*Assistant Examiner* — Alexander D Shenderov
(74) *Attorney, Agent, or Firm* — Duft & Bornsen, PC

(57) ABSTRACT

A coating apparatus is connectable to both an image forming apparatus and a sheet feeder. The coating apparatus includes a coater, a carry-in entrance, and an ejector. The coater coats a recording medium with a treatment liquid. The carry-in entrance is on one of two exterior wall surfaces facing each other. The recording medium is conveyed from the sheet feeder through the carry-in entrance. The ejector is on another of the two exterior wall surfaces. The ejector ejects the recording medium to the image forming apparatus. A position of the carry-in entrance on the one of the exterior wall surfaces matches a position of the ejector on said another of the exterior wall surfaces.

9 Claims, 13 Drawing Sheets

(56) References Cited

U.S. PATENT DOCUMENTS

| | | | | |
|---|---|---|---|---|
| 2016/0334750 | A1 | 11/2016 | Nakagaki | |
| 2018/0001671 | A1* | 1/2018 | Ohba | C23C 14/22 |

FOREIGN PATENT DOCUMENTS

| | | |
|---|---|---|
| JP | 2013-075515 | 4/2013 |
| JP | 2015-046568 | 3/2015 |
| JP | 2015-111653 | 6/2015 |
| JP | 2016-029716 | 3/2016 |

* cited by examiner

COATING APPARATUS AND IMAGE FORMING SYSTEM

CROSS-REFERENCE TO RELATED APPLICATION

This patent application is based on and claims priority pursuant to 35 U.S.C. § 119(a) to Japanese Patent Application No. 2018-049099, filed on Mar. 16, 2018, in the Japan Patent Office, the entire disclosure of which is incorporated by reference herein.

BACKGROUND

Technical Field

Aspects of the present disclosure relate to a coating apparatus and an image forming system.

Related Art

A coating apparatus has been known that coats a recording medium with a treatment liquid.

For example, there has been proposed an image forming system that includes an image forming apparatus including the coating apparatus mentioned above and a sheet feeder for feeding a recording medium to the image forming apparatus. The coating apparatus applies a treatment liquid for suppressing bleeding of ink onto the recording medium carried in the image forming apparatus from the sheet feeder. The recording medium coated with the treatment liquid is conveyed to an image forming unit.

SUMMARY

In an aspect of the present disclosure, there is provided a coating apparatus that is connectable to both an image forming apparatus and a sheet feeder. The coating apparatus includes a coater, a carry-in entrance, and an ejector. The coater coats a recording medium with a treatment liquid. The carry-in entrance is on one of two exterior wall surfaces facing each other. The recording medium is conveyed from the sheet feeder through the carry-in entrance. The ejector is on another of the two exterior wall surfaces. The ejector ejects the recording medium to the image forming apparatus. A position of the carry-in entrance on the one of the exterior wall surfaces matches a position of the ejector on said another of the exterior wall surfaces.

In another aspect of the present disclosure, there is provided an image forming system that includes the sheet feeder, the coating apparatus connected to the sheet feeder, and the image forming apparatus connected to the coating apparatus.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
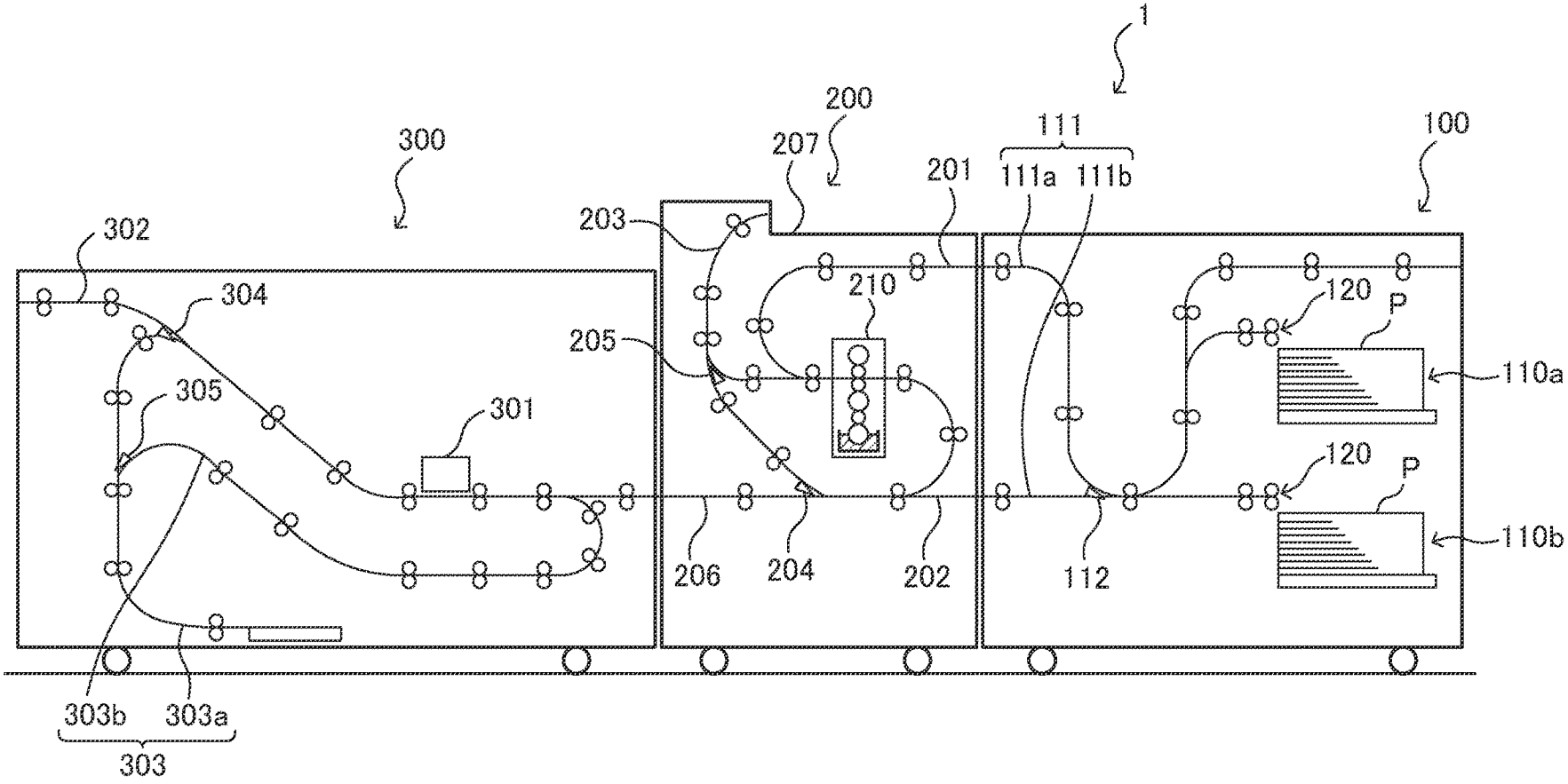
FIG. 1 is a schematic diagram illustrating a schematic configuration of an image forming system according to the present embodiment.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

Overall Description

FIG. 1 is a schematic diagram illustrating a schematic configuration of an image forming system 1 according to the present embodiment.

The image forming system 1 according to the present embodiment mainly includes a sheet feeder 100, a coating apparatus 200, and an image forming apparatus 300. In the image forming system, the coating apparatus 200 applies a treatment liquid to a paper sheet P that is a recording medium fed from the sheet feeder 100, then the image forming apparatus 300 forms an image with ink that is a liquid for forming an image, and then the paper sheet is ejected.

Sheet Feeder

The sheet feeder 100 includes two paper feeding trays 110*a* and 110*b* on which a plurality of paper sheets P is placed, and a sheet feeding section 120 separates and feeds the paper sheet one by one from the paper feeding trays 110*a* and 110*b* to convey the paper sheet P to the coating apparatus 200. A feeding path 111 that feeds the paper sheet in the sheet feeder 100 is split into a first feeding path 111*a* for feeding the paper sheet P to a coating conveying path 201 passing through a coater 210 of the coating apparatus 200 halfway and a second feeding path 111*b* for feeding the paper sheet P to a relay conveying path 202 that conveys the paper sheet P to the image forming apparatus without via the coater 210 of the coating apparatus 200. The position splitting into the first feeding path 111*a* and the second feeding path 111*b* is provided with a feeding path switching claw 112 that guides the paper sheet P to either the first feeding path 111*a* or the second feeding path 111*b*. When processing of applying the treatment liquid onto the paper sheet P is performed, the paper sheet P is guided by the feeding path switching claw 112 and conveyed to the first feeding path 111*a*. When the treatment liquid is not applied, the paper sheet P is guided by the feeding path switching claw 112 and conveyed to the second feeding path 111*b*.

Coating Apparatus

The coating apparatus 200 includes the coater 210 as a coater that applies the treatment liquid onto the paper sheet P. The coating apparatus 200 further includes the coating conveying path 201 as a first path connected to the first feeding path 111*a* of the sheet feeder 100 and passing through the coater 210, the relay conveying path 202 as a second path connected to the second feeding path 111*b* of the sheet feeder 100 and not passing through the coater 210, a coating reverse conveying path 203 as a reversing path that reverses the paper sheet P coated with the treatment liquid on one side thereof and conveys it to the coater again, and a coating sheet ejection path 206 that conveys the paper sheet P to the image forming apparatus. On the downstream side in the conveyance direction from a junction at which the coating conveying path 201 and the relay conveying path 202 join together, the conveying path is split into the coating reverse conveying path 203 and the coating sheet ejection path 206. The position splitting into the coating reverse conveying path 203 and the coating sheet ejection path 206 is provided with a coating switching claw 204 as a switching means that guides the paper sheet P to either the coating reverse conveying path 203 or the coating sheet ejection path 206.

The coating apparatus 200 is provided with, on the upper surface thereof, a paper discharge purge 207 for ejecting the paper sheet P remaining in the conveying path at the time of occurrence of a paper jam. The paper sheet P remaining in the conveying path at the time of occurrence of the paper jam is conveyed to the coating reverse conveying path 203, and is ejected to the paper discharge purge 207.

The coater 210 applies the treatment liquid on one side of the paper sheet P delivered from the first feeding path 111*a* of the sheet feeder 100 to the coating conveying path 201 to form a liquid film layer of the treatment liquid. When the treatment liquid is applied to only one side of the paper sheet, the paper sheet P is guided to the coating sheet ejection path 206 by the coating switching claw 204, and is conveyed to the image forming apparatus 300.

On the other hand, when the treatment liquid is applied to both sides of the paper sheet P, the paper sheet P is guided to the coating reverse conveying path 203 by the coating switching claw 204, switched back, and then guided by a re-conveyance claw 205 to be conveyed to the coater 210 again. Then, the treatment liquid is applied to the other side of the paper sheet by the coater 210 so that the liquid file layer of the treatment liquid is formed on both sides. Thereafter, the paper sheet is guided to the coating sheet ejection path 206 by the coating switching claw 204, and is conveyed to the image forming apparatus 300.

The paper sheet P delivered from the second feeding path 111*b* of the sheet feeder 100 to the relay conveying path 202 is guided to the coating sheet ejection path 206 by the coating switching claw 204, and is conveyed to the image forming apparatus 300 without being coated with the treatment liquid.

Image Forming Apparatus

The image forming apparatus 300 includes an inkjet recording unit 301. The inkjet recording unit 301 ejects inks of four colors of cyan (C), magenta (M), yellow (Y), and black (K) to form an image, which includes an individual liquid ejection head for each ink. A configuration of the liquid ejection head is not limited as long as it ejects liquid, and any configuration can be adopted. As necessary, a liquid ejection head for ejecting a special ink such as white, gold, and silver may be provided, or a liquid ejection head for ejecting a liquid not to form an image, such as a surface coating liquid, may be provided.

Ejection operation of each liquid ejection head of the inkjet recording unit 301 is controlled by a drive signal corresponding to image information. At the time when the paper sheet P passes through the region facing the inkjet recording unit 301, ink of each color is ejected from each liquid ejection head, and an image corresponding to the image information is formed. Note that, in the present embodiment, a configuration of the inkjet recording unit 301 is not limited as long as it attaches a liquid onto the paper sheet P to form an image.

The image forming apparatus 300 further includes a reversing path 303, and when an image is formed on both sides of the paper sheet P, the paper sheet P is guided to the reversing path 303 by the switching claw provided at the branch point between the reversing path 303 and a sheet ejection path 302. The paper sheet guided to the reversing path 303 is switched back at a switchback path 303*a*, then guided to a re-conveyance path 303*b* by a re-conveyance claw 305, and then conveyed to the inkjet recording unit 301 again. Then, the inkjet recording unit 301 forms an image on the other side of the paper sheet P, and then the paper sheet P is conveyed to the sheet ejection path 302, and is ejected.

On the other hand, when an image is formed on one side of the paper sheet P, after an image is formed on one side of the paper sheet by the inkjet recording unit 301, the paper sheet is conveyed to the sheet ejection path 302, and is ejected.

Figure 2:
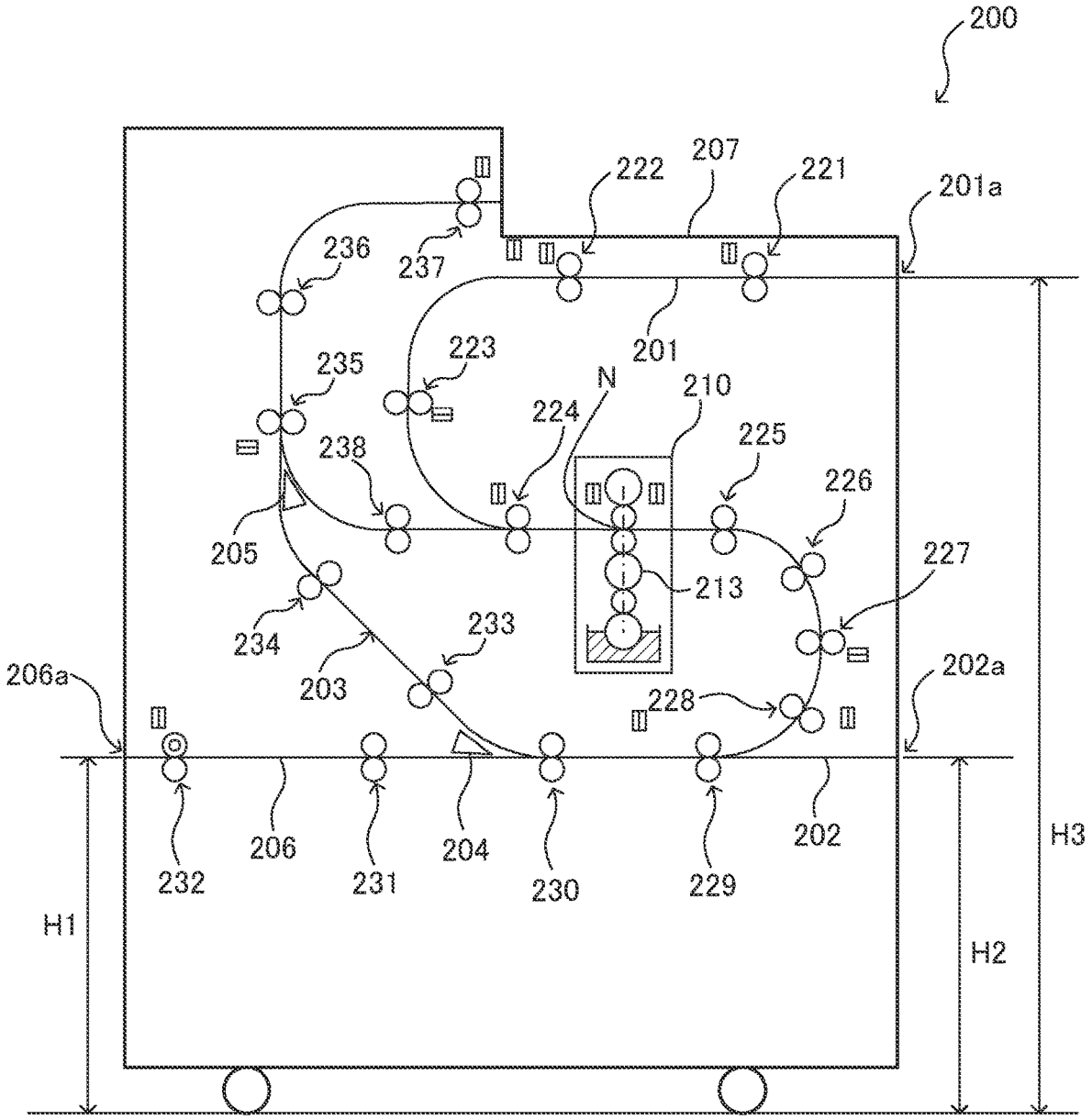
FIG. 2 is a schematic diagram illustrating a schematic configuration of a coating apparatus.

FIG. 2 is a schematic diagram illustrating a schematic configuration of the coating apparatus 200.

In the respective conveying paths 201, 203, and 206 of the coating apparatus 200, pairs of conveying rollers 221 to 238 that hold and convey the paper sheet P are disposed.

The paper sheet P delivered from the first feeding path 111*a* of the sheet feeder 100 to the coating conveying path 201 is held and conveyed by the pairs of conveying rollers 221, 222, and 223, and then held and conveyed to the coater 210 by the pair of conveying rollers 224. The paper sheet P one side of which is coated with the treatment liquid applied by the coater 210 is held and conveyed by the pairs of conveying rollers 225, 226, 227, 228, 229, and 230 in that order. When the treatment liquid is applied to both sides, upon detection of the front edge of the paper sheet by a paper sheet sensor disposed in the vicinity of the pair of conveying rollers 230, the coating switching claw 204 in a first posture for guiding the paper sheet P to the coating sheet ejection path 206 rotates clockwise in the drawing at a predetermined angle to be in a second posture for guiding the paper sheet P to the coating reverse conveying path 203. Accordingly, the paper sheet P is guided to the coating reverse conveying path 203 by the coating switching claw 204, and held and conveyed by the pairs of conveying rollers 233, 234, 235, 236, and 237 in that order.

When it is detected that the front edge of the paper sheet in the conveyance direction has reached the pair of conveying rollers 237 on the basis of the detection result of the paper sheet sensor provided in the coating reverse conveying path 203, the pairs of conveying rollers 237, 236, and 235 rotate reversely to switch back the paper sheet. Further, the re-conveyance claw 205 rotates counterclockwise in the drawing at a predetermined angle, and the paper sheet is guided to the pair of conveying rollers 238 by the re-conveyance claw. The paper sheet is then held by the pair of conveying rollers 238 and the pair of conveying rollers 224 in that order to be conveyed to the coater 210, and the coater 210 applies the treatment liquid onto the other side. Thereafter, the paper sheet is held and conveyed by the pairs of conveying rollers 225, 226, 227, 228, 229, 230, 231, and 232, and is conveyed to the image forming apparatus 300.

Figure 3:
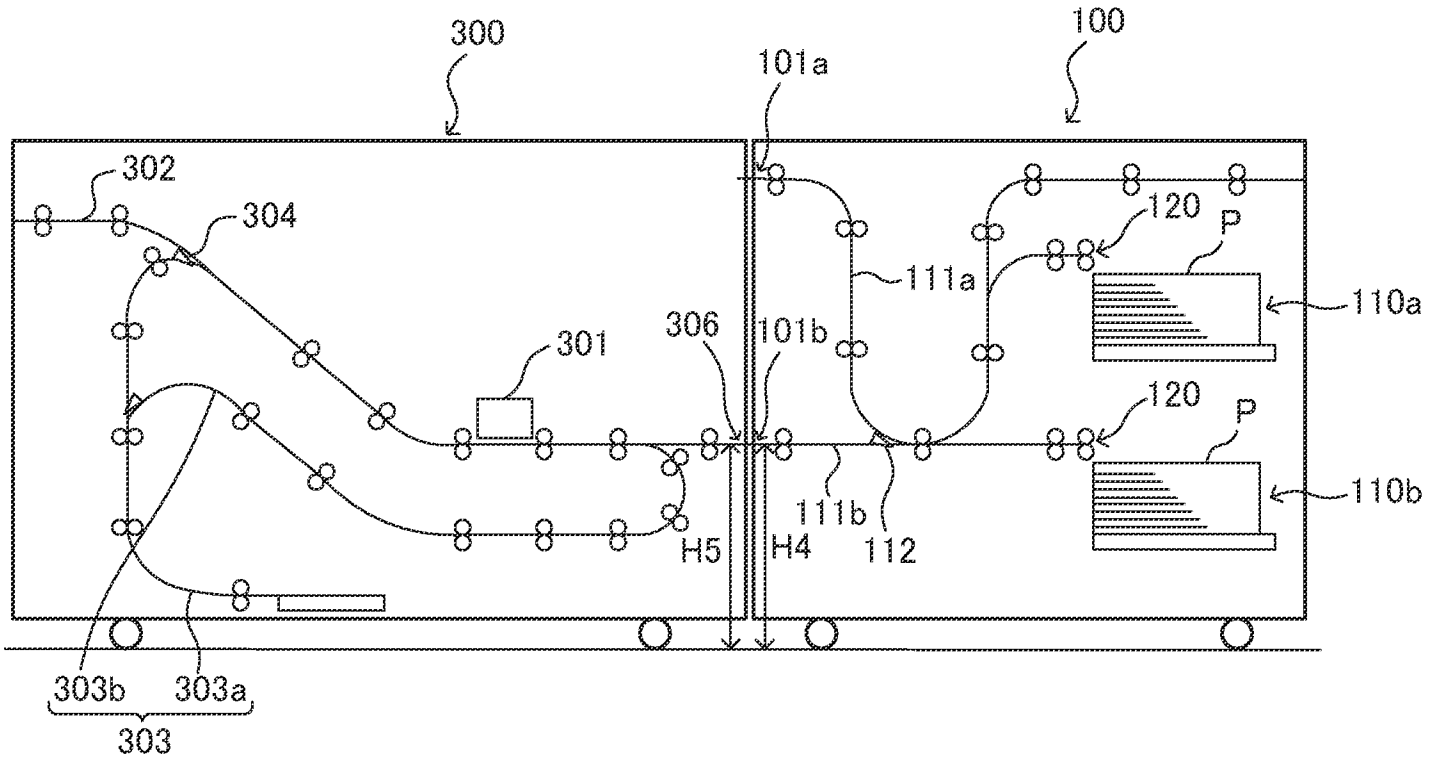
FIG. 3 is a schematic diagram illustrating a schematic configuration of an image forming system including an image forming apparatus and a sheet feeder.

The coating apparatus 200 is connectable to both the sheet feeder 100 and the image forming apparatus 300, and can be retrofitted to the image forming system including the image forming apparatus 300 and the sheet feeder 100 illustrated in FIG. 3.

As illustrated in FIG. 3, in the image forming system including the image forming apparatus 300 and the sheet feeder 100, the paper sheet P fed from a paper feeding tray 110 is conveyed to the second feeding path 111*b*. A height H4 and a position in the sheet width direction of a second ejector 101*b* of the second feeding path 111*b* match a height H5 and a position in the sheet width direction of a carry-in entrance 306 of the image forming apparatus 300. The position of the second ejector 101*b* on the exterior wall surface on which the second ejector 101*b* of the second feeding path 111*b* is formed matches the position of the carry-in entrance on the exterior wall surface on which the carry-in entrance 306 of the image forming apparatus is formed. Accordingly, when the image forming apparatus 300 and the sheet feeder 100 face each other, the second ejector 101*b* and the carry-in entrance 306 can face each other, whereby the paper sheet P ejected from the second ejector 101*b* of the second feeding path 111*b* is smoothly conveyed to the image forming apparatus.

In order to convey the paper sheet ejected from the second ejector 101*b* of the sheet feeder 100 to a carry-in entrance 202*a* of the relay conveying path 202 of the coating apparatus 200, a height H2 and a position in the width direction of the carry-in entrance are matched to the height H4 and the position in the sheet width direction of the second ejector 101*b* of the sheet feeder 100. In addition, in order to convey the paper sheet P from a ejector 206*a* of the coating apparatus 200 to the carry-in entrance 306 of the image forming apparatus 300, a height H1 and a position in the sheet width direction of the ejector 206*a* are matched to the height H5 and the position in the sheet width direction of the carry-in entrance 306 of the image forming apparatus 300. As a result, the height H2 and the position in the width direction of the carry-in entrance 202*a* of the relay conveying path 202 of the coating apparatus 200 match the height H1 and the position in the width direction of the ejector 206*a* of the coating apparatus 200, and the position of the carry-in entrance 202*a* of the relay conveying path 202 on the exterior wall surface facing the sheet feeder matches the position of the ejector 206*a* on the exterior wall surface facing the image forming apparatus.

In this manner, when the coating apparatus 200 is retrofitted to the image forming system including the sheet feeder 100 and the image forming apparatus 300 illustrated in FIG. 3 at the position between the sheet feeder 100 and the image forming apparatus 300, the carry-in entrance 202*a* of the relay conveying path 202 faces the second ejector 101*b* of the sheet feeder 100. In addition, the ejector 206*a* faces the carry-in entrance 306 of the image forming apparatus 300. Accordingly, in the image forming system including the image forming apparatus 300 and the sheet feeder 100, the paper sheet can be conveyed from the second ejector of the sheet feeder 100, which is for ejecting the paper sheet to the carry-in entrance of the image forming apparatus, to the carry-in entrance 202*a* of the relay conveying path 202. Further, in the image forming system including the image forming apparatus 300 and the sheet feeder 100, the paper sheet ejected from the ejector of the coating apparatus 200 can be conveyed to the carry-in entrance of the image forming apparatus for carrying in the paper sheet from the second ejector of the sheet feeder 100.

Accordingly, when the need of the coating apparatus 200 increases such as the case where the problem of bleeding of ink becomes obvious, only the coating apparatus 200 needs to be purchased, whereby the economic burden of a user can be reduced compared with a case of replacement with an image forming system including an image forming apparatus provided with the coating apparatus 200 and a sheet feeder.

Moreover, an inexpensive image forming system including only the sheet feeder 100 and the image forming apparatus 300 can be provided for a user who does not need the coating apparatus 200, and an image forming system including the sheet feeder 100, the coating apparatus 200, and the image forming apparatus 300 can be provided for a user who desires to output a high-quality image without ink bleeding. Therefore, it is possible to provide an image forming system that meets the needs of users.

Figure 4:
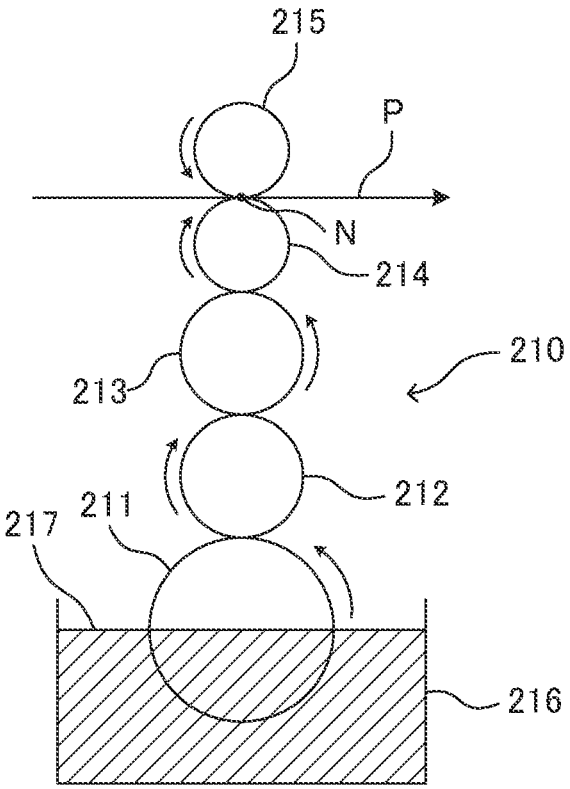
FIG. 4 is a schematic diagram illustrating a schematic configuration of a coater.

FIG. 4 is a schematic diagram illustrating a schematic configuration of the coater 210.

The coater 210 includes a supply pan 216 that stores a treatment liquid 217, a squeeze roller 211 that is partially immersed in the treatment liquid 217 in the supply pan and pumps the treatment liquid 217 in the supply pan 216, a first intermediate roller 212 to which the treatment liquid is delivered from the squeeze roller 211, a second intermediate roller 213 to which the treatment liquid is delivered from the first intermediate roller 212, a coating roller 214 to which the treatment liquid 217 is delivered from the second intermediate roller 213 and applies the treatment liquid onto the paper sheet P, and a pressure roller 215 that abuts on the coating roller 214 to form a coating nip.

Examples of the treatment liquid 217 include a modifier that modifies the surface of the paper sheet by being applied to the surface of the paper sheet P. Specifically, a fixing agent (setting agent) capable of, when being uniformly applied to the paper sheet in advance, allowing the moisture of the ink to quickly permeate the paper sheet, thickening a color component, accelerating drying to suppress spreading (feathering, bleeding, etc.) and strike-through, and increasing productivity (the number of images to be output per unit time) may be used.

Compositionally, examples of the treatment liquid 217 include a solution in which cellulosic material (hydroxy propyl cellulose, etc.) that promotes permeation of the moisture and a base material such as talc fine powder are added to surfactant (one of anionic, cationic, and nonionic surfactant, or a mixture of two or more thereof). Fine particles may be further contained.

The treatment liquid 217 pumped by the squeeze roller 211 is delivered to the coating roller 214 with the film thickness controlled by the first and second intermediate rollers. Then, the coating roller 214 applies the treatment liquid 217 onto the paper sheet P conveyed to a coating nip N.

In the present embodiment, the application amount of the treatment liquid 217 to the paper sheet P can be changed depending on the type of the paper sheet or the like. For example, the pressure applied to the pressure roller 215 and the coating roller 214 may be adjusted to change the coating nip pressure, whereby the application amount of the treatment liquid can be changed. It is also possible to change the application amount by changing the rotation speed of each of the rollers 211, 212, 213, and 214. Further, an angle of the supply pan 216 may be changed to change the immersion amount of the squeeze roller with respect to the treatment liquid, thereby changing the application amount.

The coating roller 214 has an inverted crown shape in which the diameter decreases toward the center in the axial direction. With the coating roller 214 being formed in the inverted crown shape, the treatment liquid can be applied while the paper sheet that has entered the coating nip N is stretched in the axial direction, whereby the treatment liquid can be uniformly applied.

In the present embodiment, when the treatment liquid is applied to both sides of a paper sheet of the number of a predetermined number or more, interleaf conveyance control is performed. The interleaf conveyance control is conveyance control in which, after the treatment liquid is applied to one side of a plurality of paper sheets, conveyance of the paper sheet one side of which is coated with the treatment liquid to the coater 210 and conveyance of the paper sheet both sides of which are uncoated with the treatment liquid to the coater 210 are alternately performed.

Figure 5:
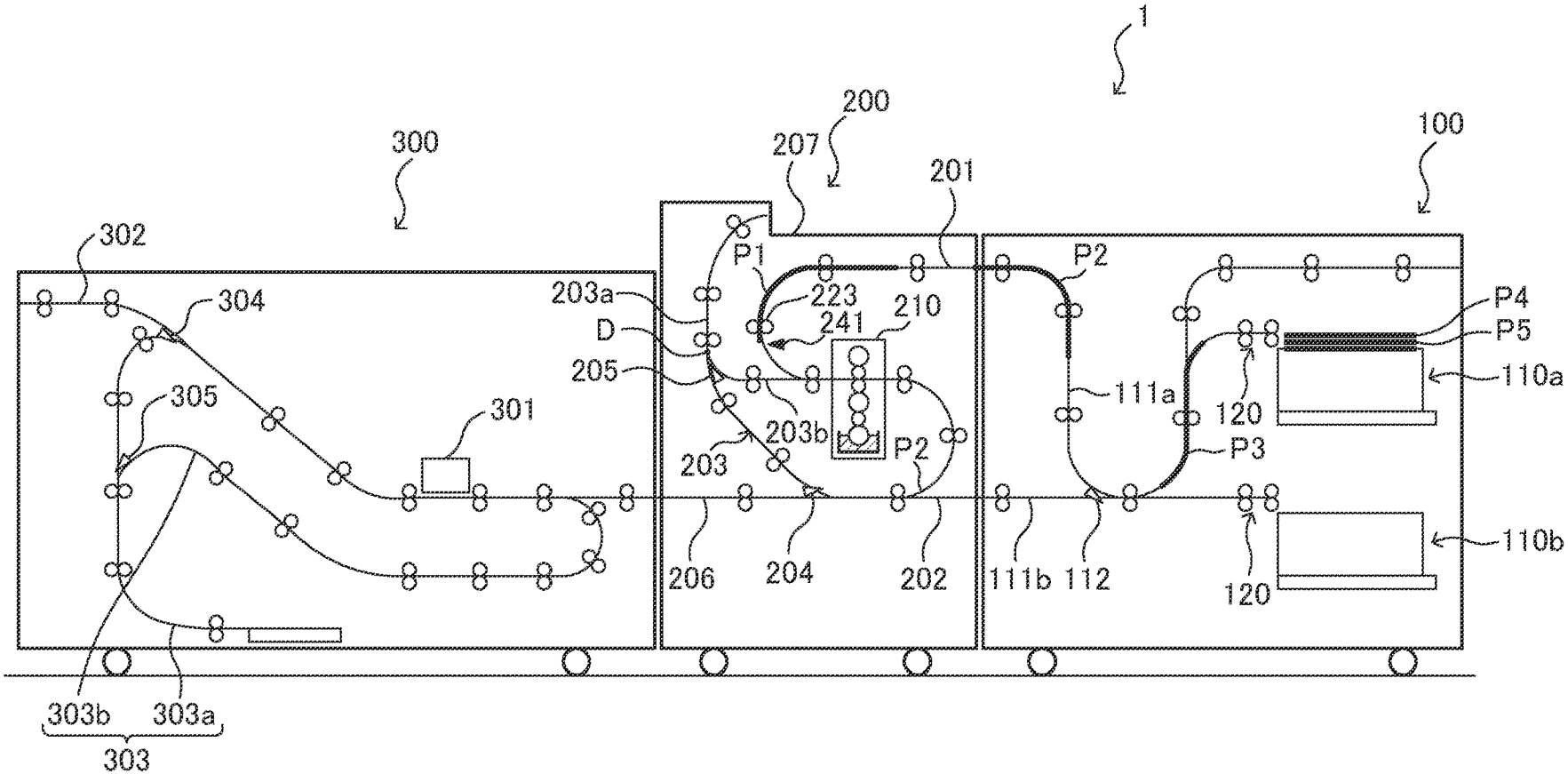
FIG. 5 is a diagram for illustrating a state of continuously conveying a paper sheet to the coater.
Figure 6:
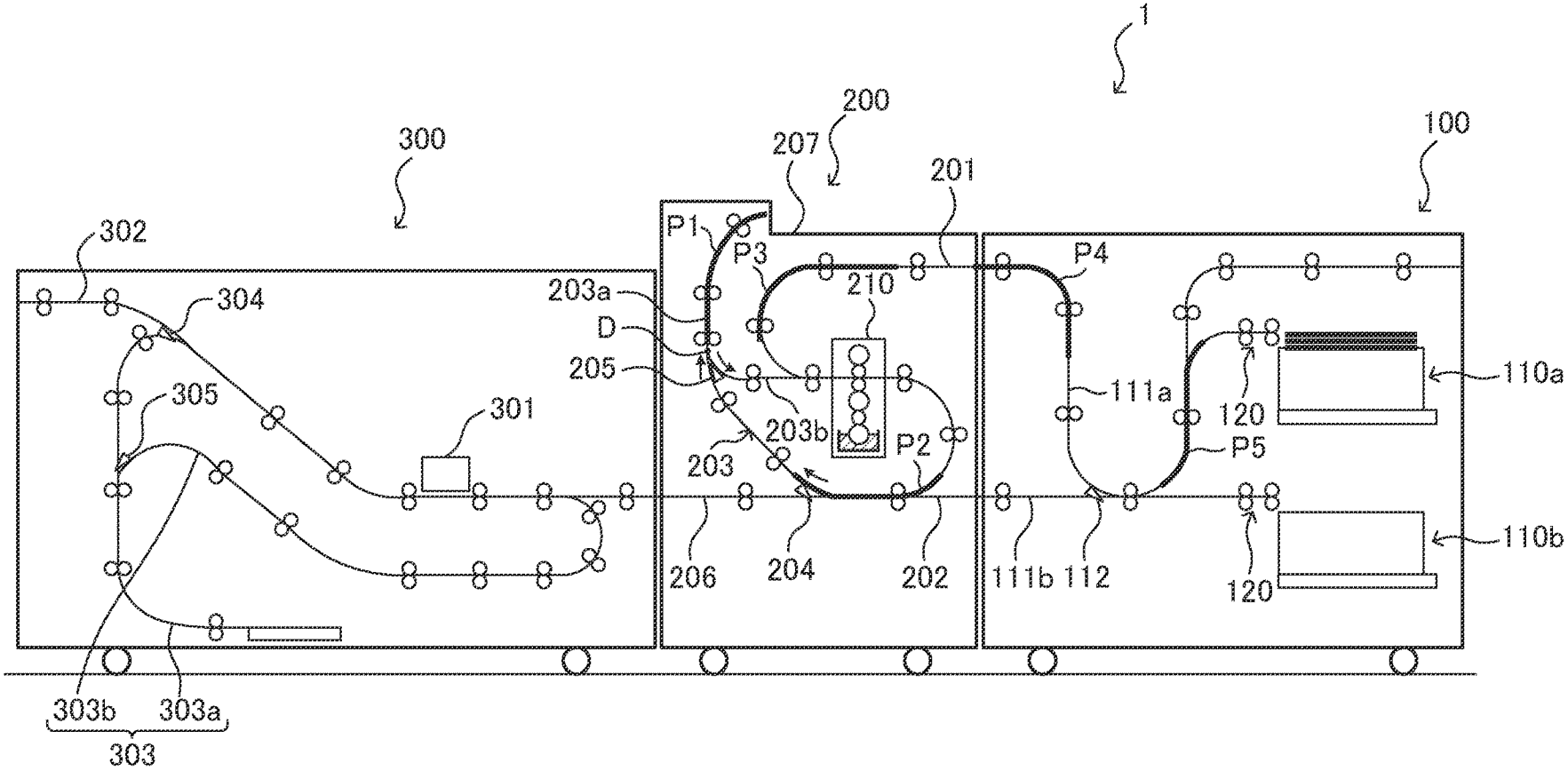
FIG. 6 is a diagram illustrating a state in which a first paper sheet temporarily stops at a switchback section of a coating reverse conveying path in interleaf conveyance control.
Figure 7:
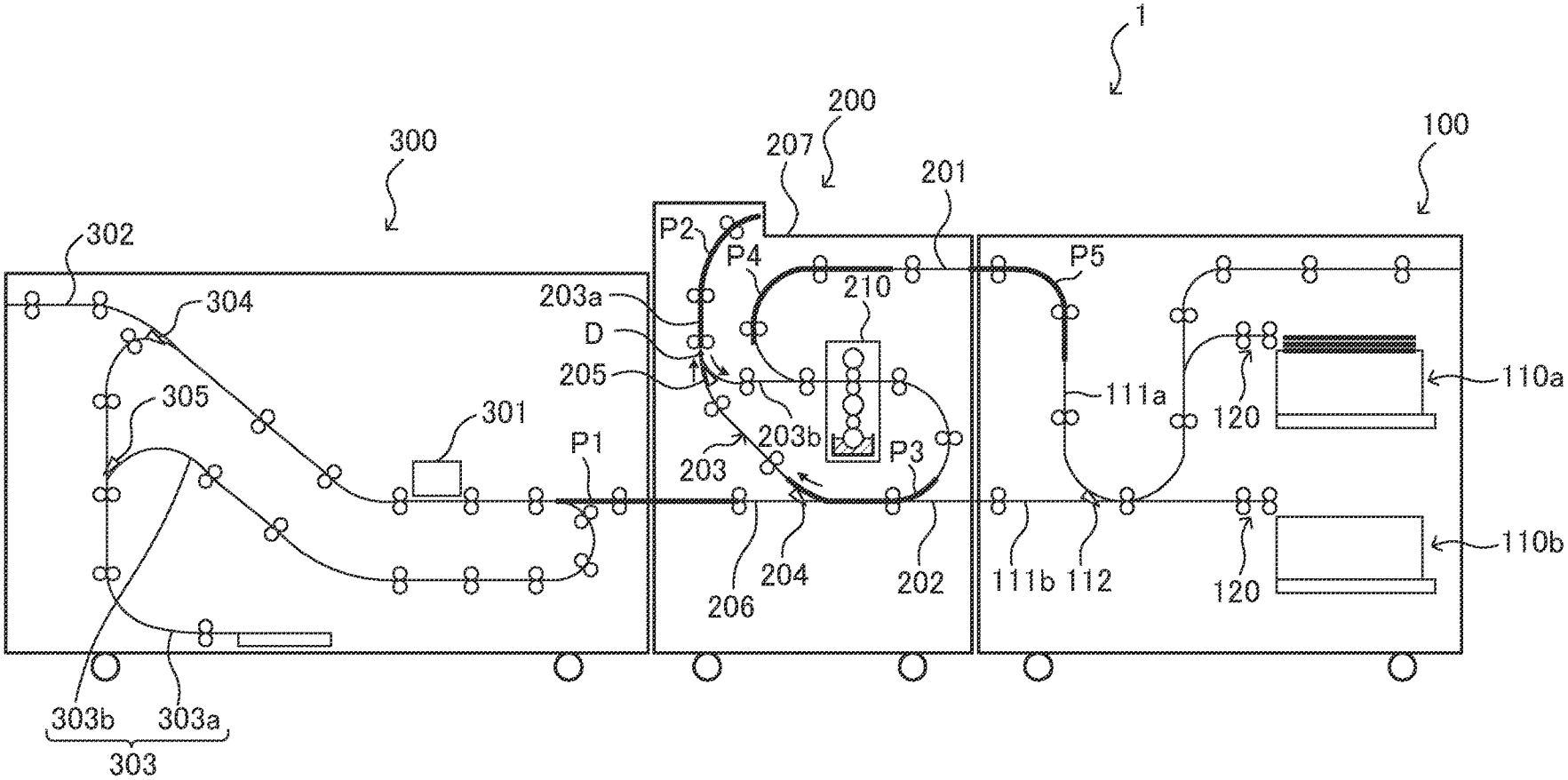
FIG. 7 is a diagram illustrating a state in which a second paper sheet temporarily stops at the switchback section of the coating reverse conveying path in the interleaf conveyance control.

FIGS. 5 to 7 are diagrams illustrating the interleaf conveyance control.

Note that FIGS. 5 to 7 illustrates the interleaf conveyance control in the case where the treatment liquid is applied to both sides of five paper sheets P (P1 to P5).

First, as illustrated in FIG. 5, the paper sheet P is continuously conveyed from one of the two paper feeding trays 110*a* and 110*b* (in this example, the upper paper feeding tray 110*a*) at a predetermined interval. At this time, the feeding path switching claw 112 disposed at the branch point between the first feeding path 111*a* and the second feeding path 111*b* of the sheet feeder 100 is in the posture for guiding the paper sheet to the first feeding path 111*a*. The fed paper sheets P1 to P5 are therefore conveyed to the first feeding path 111*a*, and then delivered to the coating conveying path 201 of the coating apparatus 200 from the first feeding path 111*a*.

When a paper sheet sensor 241, which is disposed in the vicinity of the pair of conveying rollers 223 positioned before the junction in the paper conveyance at which the coating reverse conveying path 203 joins the coating conveying path 201, detects the front edge of the first paper sheet, the conveyance of the paper sheet is temporarily stopped. When the coating apparatus 200 and the sheet feeder 100 receive a re-transmission instruction from the image forming apparatus, the conveyance is restarted. Likewise, for the second and subsequent paper sheets, the conveyance is temporarily stopped when the paper sheet sensor 241 detects the front edge of the paper sheet, and the conveyance is restarted when the coating apparatus 200 and the sheet feeder 100 receive the re-transmission instruction from the image forming apparatus. Note that the conveyance control in the preceding descriptions is also performed in a similar manner when the treatment liquid is applied to only one side of the paper sheet.

The coater 210 applies the treatment liquid to one side of each of the first paper sheet P1 and the second paper sheet P2 successively, and the first paper sheet P1 and the second paper sheet P2 are conveyed to the coating reverse conveying path 203. As illustrated in FIG. 6, when the first paper sheet P1 is conveyed to a switchback section 203*a* of the coating reverse conveying path 203, the conveyance of the first paper sheet P1 and the second paper sheet P2 is temporarily stopped, and stands by until the re-transmission instruction from the image forming apparatus is received.

Subsequently, when the re-transmission instruction for the first paper sheet P1 is received, the first paper sheet P1 is switched back and conveyed to the coater 210 again, and the treatment liquid is applied onto the other side thereof. Further, the second paper sheet P2 temporarily stopped in the conveying path from the coater 210 to the switchback section 203*a* is conveyed to the switchback section 203*a*. Furthermore, during this time, the front edge of the third paper sheet P3 reaches the paper sheet sensor 241 disposed in the vicinity of the pair of conveying rollers 223, and temporarily stops at the position before the junction between the coating reverse conveying path 203 and the coating conveying path 201.

In the present embodiment, the length of the conveying path from the coater 210 to an entrance D of the switchback section 203*a* of the coating reverse conveying path 203 is set to be longer than the maximum length of the paper sheet in the conveyance direction that can be placed on the paper feeding trays 110*a* and 110*b* of the sheet feeder 100. Accordingly, when the paper sheet stands by in the switchback section 203*a*, one or more paper sheets can stand by in the conveying path from the coater 210 to the entrance D of the switchback section 203*a* of the coating reverse conveying path 203, whereby the interleaf conveyance control can be performed.

Next, when a predetermined period of time has elapsed since the first paper sheet P1 has been conveyed to the coater 210, the third paper sheet P3 is conveyed to the coater 210, and the treatment liquid is applied to one side of the third paper sheet P3. When the rear edge of the second paper sheet P2 is conveyed to the coating reverse conveying path 203, the coating switching claw 204 rotates counterclockwise in the drawing and changes to the posture for guiding the paper sheet to the coating sheet ejection path 206. As a result, the first paper sheet P1 both sides of which are coated with the treatment liquid is conveyed to the coating sheet ejection path 206, and is delivered to the image forming apparatus 300.

When the rear edge of the first paper sheet P1 passes through the branch point between the coating sheet ejection path 206 and the coating reverse conveying path 203, the coating switching claw 204 rotates clockwise in the drawing and changes to the posture for guiding the paper sheet to the coating reverse conveying path 203. As illustrated in FIG. 7, when the second paper sheet P2 is conveyed to the switchback section 203*a*, the paper conveyance of the second paper sheet P2 and the third paper sheet P3 is temporarily stopped. Subsequently, when the re-transmission instruction for the second paper sheet P2 is received, the second paper sheet is conveyed to the coater 210 again while the third paper sheet P3 is conveyed to the switchback section 203*a*. After the second paper sheet P2, the fourth paper sheet P4 is conveyed to the coater 210 and the treatment liquid is applied to one side thereof, and then the third paper sheet P3 is conveyed to the coater 210 again and the treatment liquid is applied to the other side thereof. Thereafter, the third paper sheet P3, the fifth paper sheet P5, the fourth paper sheet P4, and the fifth paper sheet P5 are conveyed to the coater 210 in that order, and the treatment liquid is applied to both sides of each of the paper sheets.

As described above, the treatment liquid is applied to both sides of the paper sheet according to the interleaf conveyance control, whereby the treatment liquid can be applied to both sides of the paper sheet while the reduction in productivity is suppressed.

Figure 8:
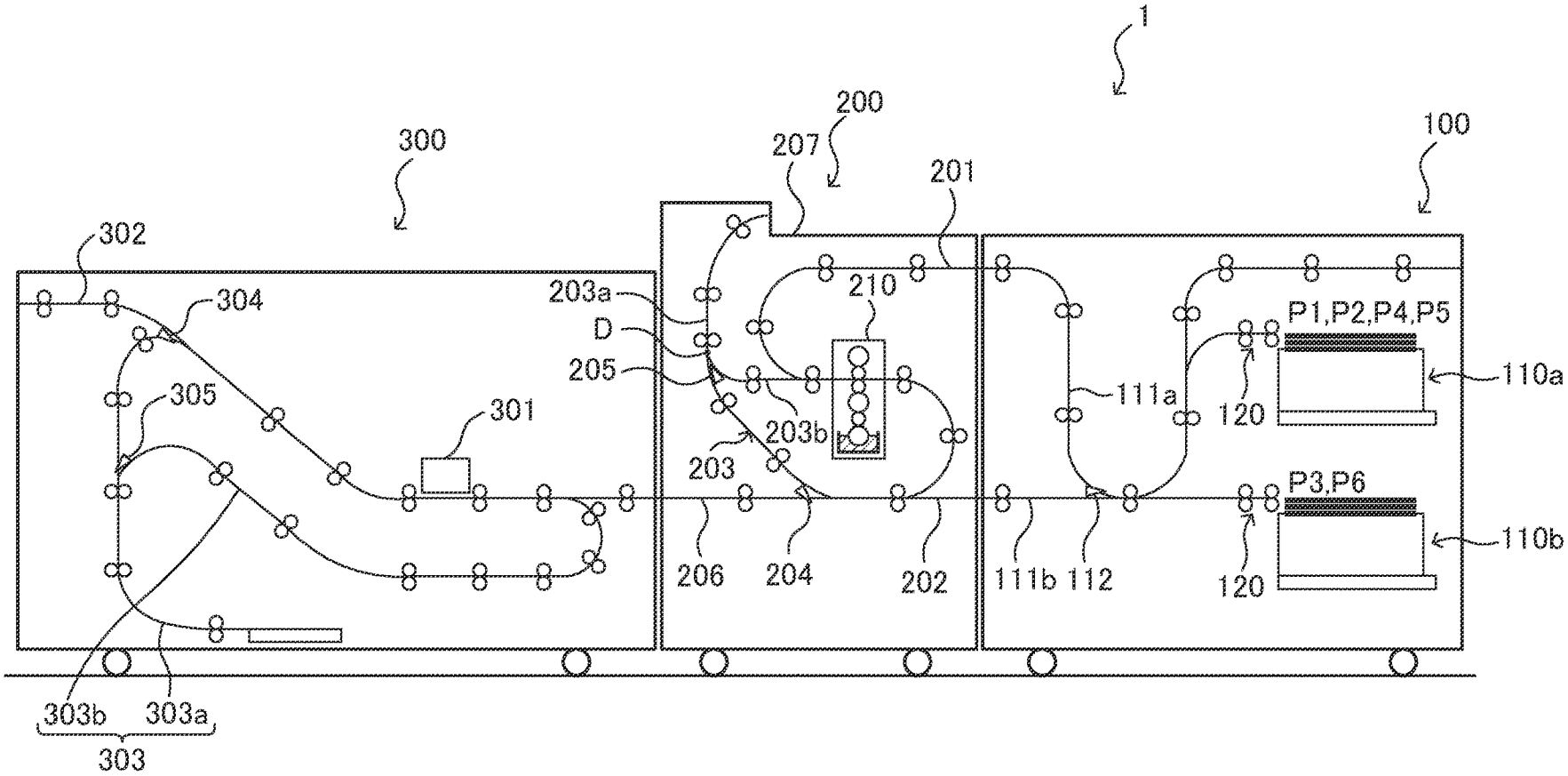
FIG. 8 is a diagram illustrating a conveyance order of paper sheets placed on each paper feeding tray in mixed conveyance.

Next, control of mixed conveyance in which a paper sheet to be subject to a coating process and a paper sheet not to be subject to the coating process are mixed in continuous sheet feeding will be described with reference to FIGS. 8 to 10.

In the following descriptions, paper sheets requiring application of the treatment liquid are placed on the upper paper feeding tray 110*a*, and paper sheets not requiring application of the treatment liquid are placed on the lower paper feeding tray 110*b*. An exemplary case where two sets of booklets are prepared using the paper sheet requiring application of the treatment liquid for first and second paper sheets and using the paper sheet not requiring application of the treatment liquid for a third paper sheet will be described.

In this case, conveyance control in which two paper sheets coated with the treatment liquid are conveyed to the image forming apparatus 300 and then one paper sheet uncoated with the treatment liquid is conveyed is performed twice. In this case, as illustrated in FIG. 8, in the order of conveyance to the image forming apparatus, sheets P3 and P6, which are the paper sheets of multiples of 3, are conveyed from the lower paper feeding tray 110*b* while the other paper sheets (P1, P2, P4, and P5) are conveyed from the upper paper feeding tray 110*a*.

First, the first and second paper sheets P1 and P2 are continuously fed from the upper paper feeding tray 110*a* at a predetermined interval. At this time, the feeding path switching claw 112 provided at the branch point between the first feeding path 111*a* and the second feeding path 111*b* is in the posture for guiding the paper sheet to the first feeding path 111*a*, and the first paper sheet P1 and the second paper sheet P2 fed to the branch point are conveyed to the first feeding path 111*a*.

At a predetermined timing after the second paper sheet P2 is fed from the upper paper feeding tray 110*a*, the third paper sheet P3 is fed from the lower paper feeding tray 110*b*. When the rear edge of the second paper sheet P2 passes through the branch point between the first feeding path 111*a* and the second feeding path 111*b*, the feeding path switching claw 112 rotates counterclockwise in the drawing, and changes to the posture for guiding the paper sheet to the second feeding path 111*b*. Accordingly, the paper sheet P3 not requiring application of the treatment liquid is conveyed to the second feeding path 111*b*.

The total conveying path length of the second feeding path 111*b* and the relay conveying path 202 is shorter than the total conveying path length of the first feeding path 111*a* and the coating conveying path 201. Therefore, as illustrated in FIG. 9, the third paper sheet P3 reaches the junction mentioned above before the first paper sheet P1 reaches the junction between the relay conveying path 202 and the coating conveying path 201. The third paper sheet P3 therefore temporarily stops at the position before the junction.

In the present embodiment, the total of the conveying path length of the second feeding path 111*b* and the conveying path length of the relay conveying path 202 is longer than the maximum length of the paper sheet in the conveyance direction that can be placed on the paper feeding trays 110*a* and 110*b*. Accordingly, while the paper sheet not requiring application of the treatment liquid is temporarily stopped at the position before the junction between the relay conveying path 202 and the coating conveying path 201, the paper sheet requiring application of the treatment liquid can be conveyed to the first feeding path 111*a*.

Further, the fourth paper sheet P4 is fed from the upper paper feeding tray 110*a* at a predetermined timing. When the third paper sheet P3 passes through the branch point between the first feeding path 111*a* and the second feeding path 111*b*, the feeding path switching claw 112 rotates clockwise in the drawing, and changes to the posture for guiding the paper sheet to the first feeding path 111*a*.

Figure 9:
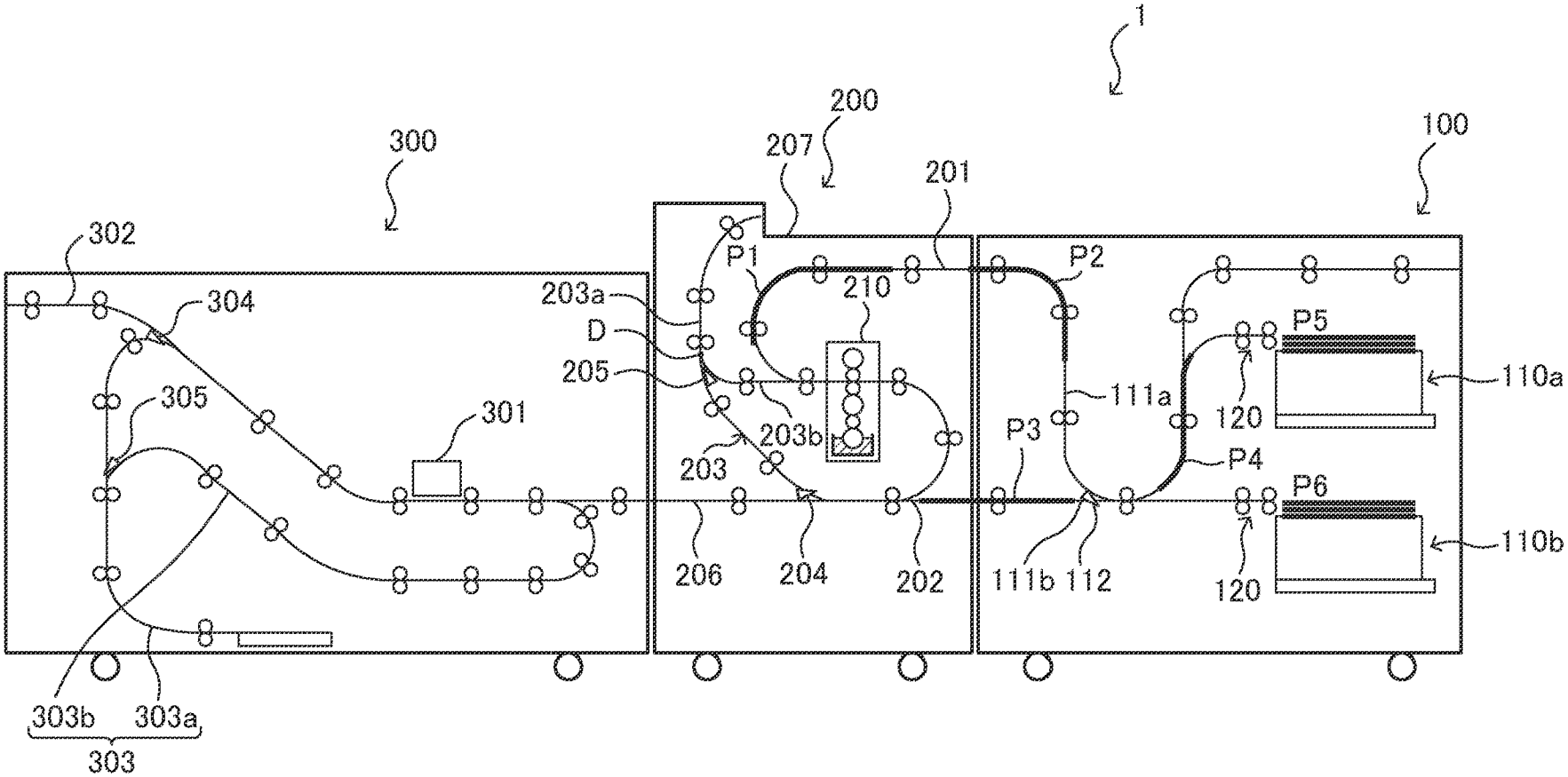
FIG. 9 is a diagram illustrating a state in which a third paper sheet not subject to a coating process temporarily stops at a position before a junction between a relay conveying path and a coating conveying path in the mixed conveyance.
Figure 10:
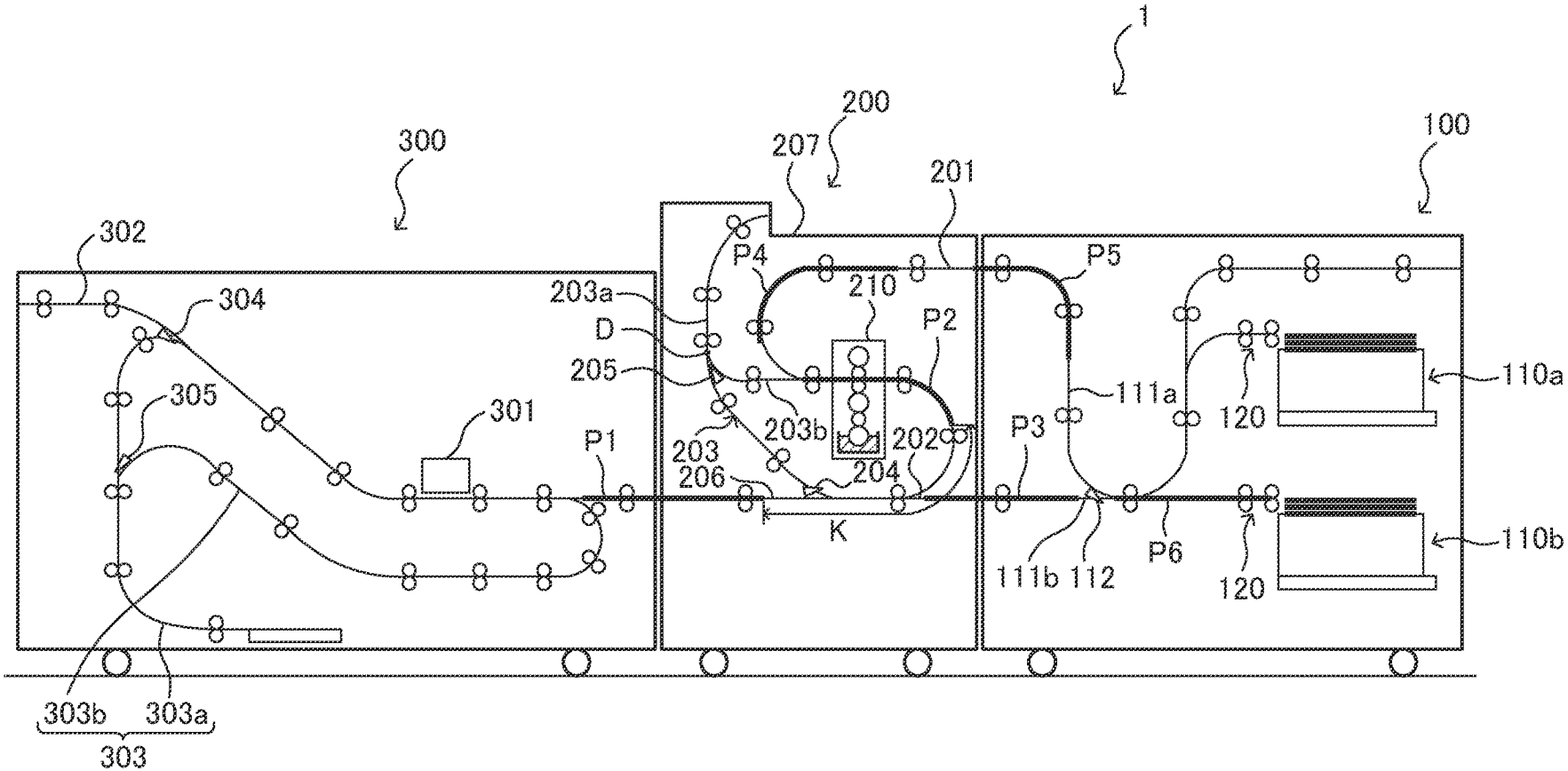
FIG. 10 is a diagram illustrating a state in which a fourth paper sheet temporarily stops at a position before the coater in the mixed conveyance.

As illustrated in FIG. 9, the first paper sheet P1 is temporarily stopped at the position before the junction between the coating reverse conveying path 203 and the coating conveying path 201, and then conveyed to the coater 210 at a predetermined timing. Likewise, the second paper sheet P2 stops at the position before the junction between the coating reverse conveying path 203 and the coating conveying path 201, and as illustrated in FIG. 10, the second paper sheet P2 is conveyed to the coater 210 at a timing when a sheet interval with respect to the first paper sheet P1 becomes a specified sheet interval K.

Next, the rear edge of the second paper sheet P2 passes through the junction between the relay conveying path 202 and the coating conveying path 201, and then conveyance of the third paper sheet P3 is started at a timing when the sheet interval with respect to the second paper sheet P2 becomes the specified sheet interval K. Before the conveyance of the third paper sheet P3 is started, the fourth paper sheet P4 reaches the position before the junction between the coating reverse conveying path 203 and the coating conveying path 201, and temporarily stops. The fourth paper sheet P4 is then conveyed to the coater 210 at a timing when the sheet interval with respect to the third paper sheet P3 becomes the specified sheet interval K.

The paper conveyance of the third paper sheet P3 is not restarted at the timing when the front edge of the sixth paper sheet P6 reaches the branch point between the first feeding path 111*a* and the second feeding path 111*b*. Therefore, the sixth paper sheet P6 temporarily stops at the position before the branch point between the first feeding path 111*a* and the second feeding path 111*b*. Then, when the conveyance of the third paper sheet P3 is restarted, the conveyance of the sixth paper sheet P6 is restarted, and the paper sheet P6 is conveyed to the second feeding path 111*b*.

As described above, in the present embodiment, the conveying path passing through the coater 210 and the conveying path not passing through the coater 210 are included, whereby the paper sheet one side of which is coated with the treatment liquid and the paper sheet both sides of which are uncoated with the treatment liquid can be mixedly conveyed while maintaining the specified sheet interval K.

Moreover, also in the case where the paper sheets P1, P2, P4, and P5 that need to be subject to the coating process are conveyed first, a job for performing the coating process and an image forming process is carried out, the paper sheets P3 and P6 are then conveyed, and then a job for performing only the image forming process is separately carried out, since the conveying path passing through the coater 210 and the conveying path not passing through the coater 210 are included, the following advantages can be obtained. That is, it is an advantage that a predetermined maintenance operation of the coater, such as cleaning of the coating roller 214 and recovery of the treatment liquid, can be executed at the time of executing the job for performing only the image forming process.

Next, ejection of remaining paper sheets at the time of occurrence of a paper jam will be described.

Figure 11:
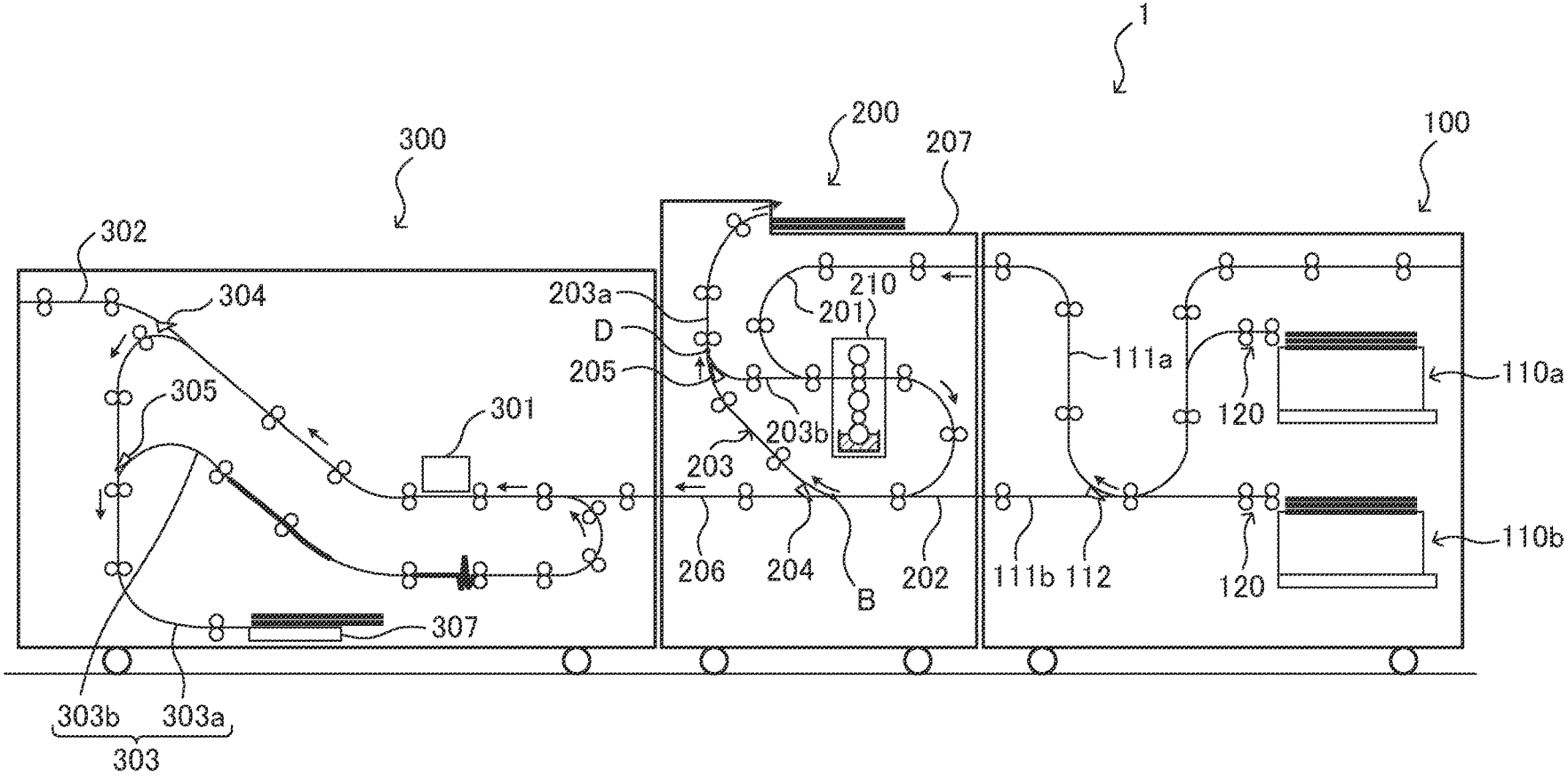
FIG. 11 illustrates exemplary ejection of remaining paper sheets at the time of occurrence of a paper jam.

FIG. 11 illustrates exemplary ejection of remaining paper sheets at the time of occurrence of the paper jam.

In the present embodiment, paper discharge purges 307 and 207 are included in the image forming apparatus 300 and the coating apparatus 200, which are for ejecting the paper sheet P remaining in the conveying path at the time of occurrence of the paper jam. As illustrated in FIG. 10, when the paper jam occurs, remaining paper sheets positioned on the upstream side of a branch point B between the coating sheet ejection path 206 and the coating reverse conveying path 203 in the paper sheet conveyance direction are ejected to the paper discharge purge 207 provided on the upper surface of the coating apparatus 200, and remaining paper sheets positioned on the downstream side of the branch point B in the paper sheet conveyance direction are ejected to the paper discharge purge 307 of the image forming apparatus 300. Accordingly, removal of the remaining papers can be easily performed when the paper jam occurs.

Further, in the present embodiment, the paper discharge purge 207 is included also in the coating apparatus 200, whereby it is not necessary to convey the remaining sheets in the sheet feeder 100 and the coating apparatus 200 to the paper discharge purge 307 of the image forming apparatus 300. Accordingly, the remaining sheets processing time can be shortened compared with the case where the remaining paper sheets in the sheet feeder are ejected to the paper discharge purge 307 of the image forming apparatus 300. In particular, in the case a large apparatus configuration as in the image forming system according to the present embodiment including the coating apparatus 200 between the sheet feeder 100 and the image forming apparatus 300, the conveying distance from the sheet feeder to the paper discharge purge of the image forming apparatus is long. Therefore, the effect of shortening the remaining sheets processing time due to the provision of the paper discharge purge 207 also in the coating apparatus 200 is high, and recovery from the paper jam can be effectively advanced.

In addition, when the paper sheet is fed from the paper feeding tray, what is called a double feed in which a plurality of paper sheets is fed in a stacked state may occur at times. Conventionally, a double feed detection means is provided in the vicinity of the sheet feeding section 120 for feeding the paper sheet placed on the paper feeding tray, and when the double feed detection means detects the double feed, the sheet feeding is stopped so that a user takes out the double-fed sheets, whereby there has been a problem that the workload of the user is large. In view of the above, in the present embodiment, the double-fed sheets are ejected to the paper discharge purge 207 of the coating apparatus 200.

Figure 12:
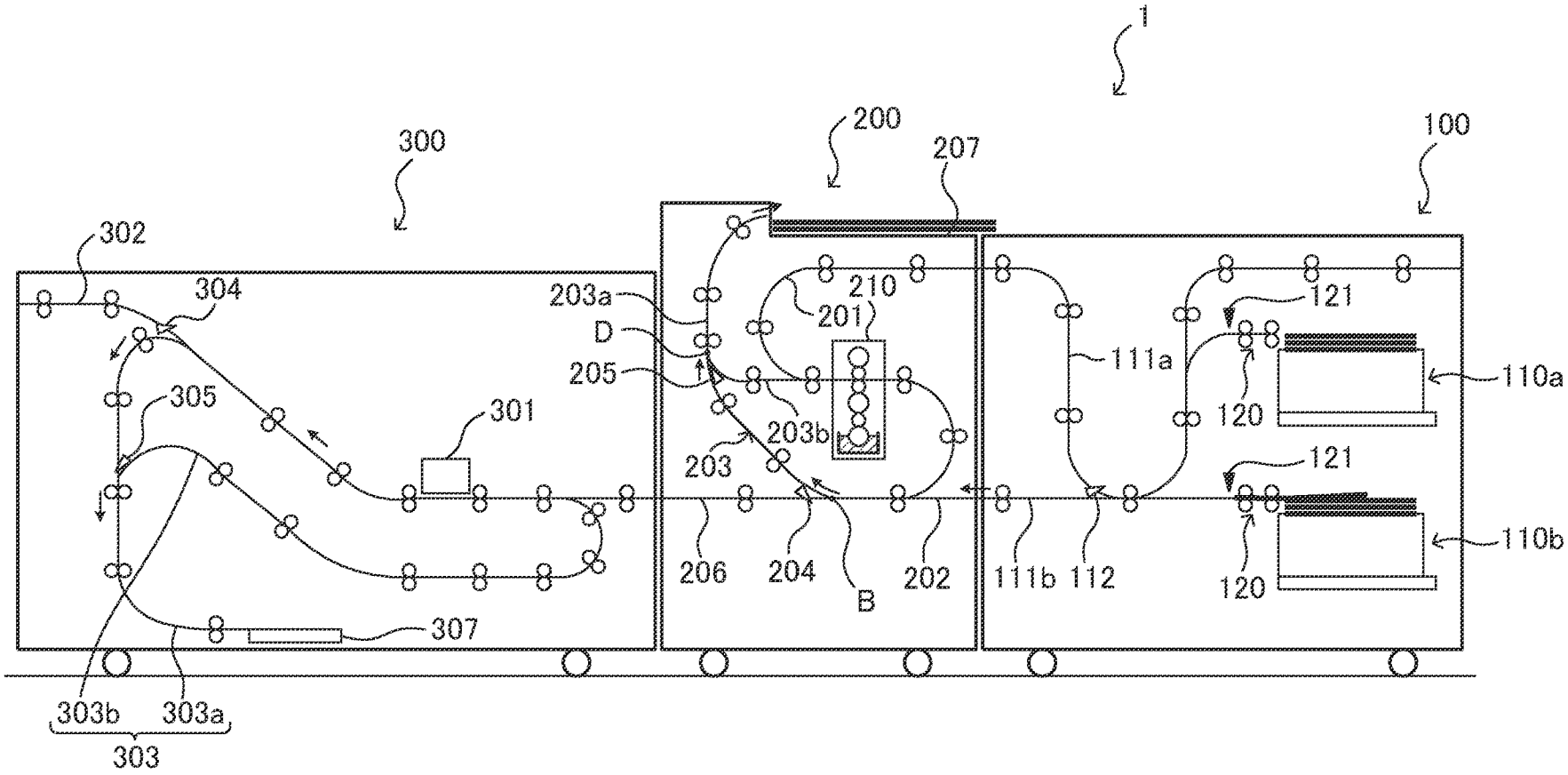
FIG. 12 is a diagram illustrating conveyance control at the time of occurrence of a double feed.

FIG. 12 is a diagram illustrating the conveyance control at the time of occurrence of the double feed.

As illustrated in FIG. 12, a double feed detection sensor 121 that detects the double feed is provided in the vicinity of the sheet feeding section 120 that separates and conveys a bundle of the paper sheets placed on the paper feeding tray. When the double feed detection sensor 121 detects the double feed, the feeding path switching claw 112 changes to the posture for guiding the paper sheet to the second feeding path 111*b*, and the double-fed sheets are conveyed to the second feeding path 111*b* as indicated by an arrow in the drawing. Thereafter, the double-fed sheets pass through the relay conveying path 202 and the coating reverse conveying path 203 as indicated by the arrow in the drawing, and are ejected to the paper discharge purge 207.

In the present embodiment, the double-fed sheets are ejected to the paper discharge purge 207, whereby operation of removing the double-fed sheets by the user can be simplified. In addition, the double-fed sheets are ejected to the paper discharge purge 207 of the coating apparatus without via the coater 210, whereby the following advantages can be obtained. That is, when the double-fed sheets are conveyed to the coater 210, they may wind around the coating roller 214 and the pressure roller 215 containing the highly viscous treatment liquid to generate the paper jam. Moreover, when the double-fed sheets wind around the coating roller 214 and the pressure roller 215, the coating roller 214 and the pressure roller 215 may be damaged. In view of the above, by the double-fed sheets being conveyed to the paper discharge purge 207 of the coating apparatus without via the coater 210, the occurrence of the paper jam at the coater 210 can be suppressed, and the occurrence of damage of the coating roller 214, the pressure roller 215, and the like can be suppressed.

Figure 13:
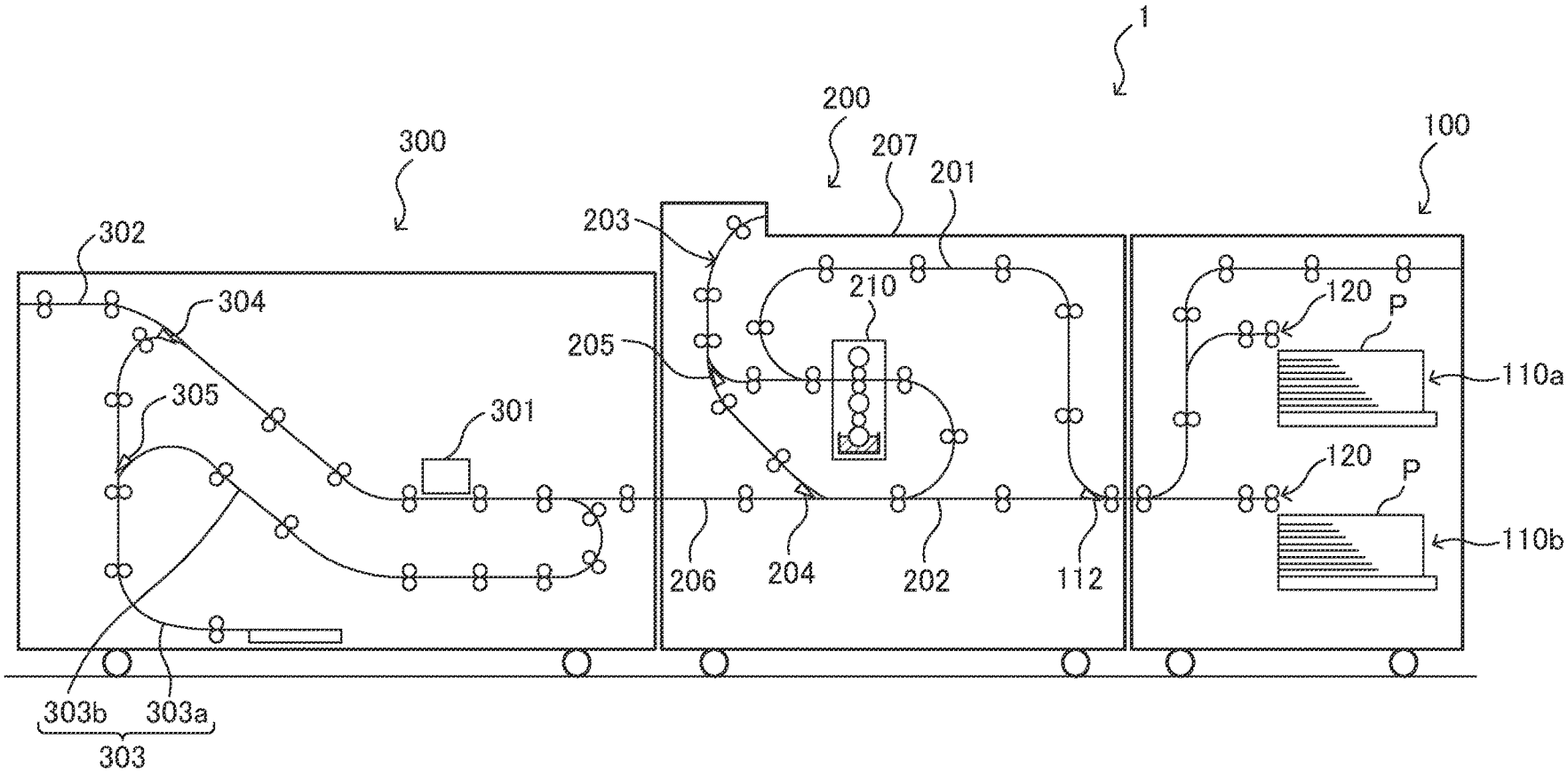
FIG. 13 is a diagram illustrating a variation of the image forming system.

FIG. 13 illustrates a variation of the image forming system.

As illustrated in FIG. 13, a coating apparatus of the image forming system according to the variation includes a branch point branching into a conveying path passing through a coater and a conveying path not passing through the coater. Accordingly, the cost of the apparatus at the time of assembling the image forming apparatus 300 and the sheet feeder 100 to form the image forming system can be reduced.

The descriptions above represent merely an example, and specific effects are exerted for each of the following aspects.

(First Aspect)

A coating apparatus 200 that applies a treatment liquid to a recording medium such as a paper sheet P, which is capable of being connected to both an image forming apparatus 300 and a sheet feeder 100, includes: a carry-in entrance 202*a* formed on one of two facing exterior wall surfaces, the carry-in entrance through which the recording medium is conveyed from outside; and an ejector 206*a* formed on another one of the two facing exterior wall surfaces, the ejector to eject the recording medium to outside, in which a position of the carry-in entrance on one of the exterior wall surfaces and a position of the ejector on the other one of the exterior wall surfaces are matched.

Note that matching the positions of the ejector and the carry-in entrance indicates that the positions in two directions orthogonal to the paper sheet conveyance direction (in the present embodiment, two directions of vertical direction and sheet width direction) match each other.

In an image forming system including an image forming apparatus and a sheet feeder, the position of a sheet ejector on the exterior wall surface on which an ejector for ejecting the recording medium to the image forming apparatus is matched to the position of a carry-in entrance on the exterior wall surface on which the carry-in entrance for carrying in the recording medium from the sheet feeder.

According to a first aspect, the position of the carry-in entrance on the exterior wall surface on which the carry-in entrance of a coating apparatus is formed is matched to the position of the ejector on the exterior wall surface on which the ejector of the coating apparatus is formed. Accordingly, the position of the ejector of the sheet feeder mentioned above and the position of the carry-in entrance of the coating apparatus can be matched to each other, whereby the recording medium ejected from the ejector of the sheet feeder can be conveyed to the carry-in entrance of the coating apparatus. In addition, the position of the ejector of the coating apparatus and the position of the carry-in entrance of the image forming apparatus mentioned above can be matched to each other, whereby the recording medium ejected from the ejector of the coating apparatus can be conveyed to the carry-in entrance of the image forming apparatus.

Accordingly, even in the case of an image forming system not supposed to incorporate the coating apparatus at the time of manufacturing, the coating apparatus can be retrofitted. It becomes therefore possible to retrofit, as an option, the coating apparatus according to the first aspect in the image forming system when the need of the coating apparatus increases. As a result, replacement with an image forming system including an image forming apparatus provided with a coating apparatus and a sheet feeder becomes unnecessary, whereby the economic burden of a user can be reduced.

(Second Aspect)

The coating apparatus according to the first aspect, further includes: a first path such as a coating conveying path 201 that ejects the recording medium such as a paper sheet to the image forming apparatus 300 via a coater such as a coater 210; and a second path such as a relay conveying path 202 that ejects the recording medium to the image forming apparatus without via the coater.

In the case of the coating conveying path 201 that ejects the recording medium to the image forming apparatus 300 via the coater such as the coater 210, when the treatment liquid is not applied onto the paper sheet, a coating roller 214 as a coater is moved to a separation position spaced apart from the paper sheet, and then the paper sheet is conveyed. Therefore, in the case of conveying the paper sheet not subject to a coating process next to the paper sheet subject to the coating process, it is necessary to wait the sheet conveyance until the coating roller moves to the separation position, thereby increasing the sheet interval. Furthermore, in the case of conveying the paper sheet subject to the coating process next to the paper sheet not subject to the coating process, it is necessary to wait the sheet conveyance until the coating roller moves from the separation position to the coating position for applying the treatment liquid onto the paper sheet, thereby increasing the sheet interval.

Meanwhile, according to a second aspect, the first path such as the coating conveying path 201 that ejects the paper sheet to the image forming apparatus 300 via the coater such as the coater 210, and the second path such as the relay conveying path 202 that ejects the paper sheet to the image forming apparatus without via the coater are included, whereby it is not necessary to move the coating roller as the coater between the coating position and the separation position. Accordingly, the increase in the sheet interval can be suppressed in the case where the paper sheet not subject to the coating process is conveyed next to the paper sheet subject to the coating process or in the case where the paper sheet subject to the coating process is conveyed next to the paper sheet not subject to the coating process, whereby the reduction in productivity can be suppressed at the time when the paper sheet not subject to the coating process and the paper sheet subject to the coating process are mixedly conveyed.

(Third Aspect)

The coating apparatus according to the second aspect, further includes: a reversing path such as a coating reverse conveying path 203 that reverses the recording medium in which a first surface is coated with the treatment liquid and then conveys the recording medium to the coater again.

Accordingly, it becomes possible to apply the treatment liquid to both sides of the recording medium using the coater.

(Fourth Aspect)

In the coating apparatus according to the third aspect, a length between the coater such as the coater 210 and a rear edge of a reversing portion of the reversing path is set to a length allowing a plurality of recording media such as paper sheets to stay.

Accordingly, as described in the embodiment, the treatment liquid can be applied to both sides of the recording medium such as the paper sheet according to interleaf conveyance control, whereby the treatment liquid can be applied to both sides of the recording medium while the reduction in productivity is suppressed.

(Fifth Aspect)

In the coating apparatus according to the third or fourth aspect, at a branch point branching into the reversing path such as the coating reverse conveying path 203 and an ejecting path such as a coating sheet ejection path 206 that conveys the recording medium to the ejector, a switch such as a coating switching claw 204 that selectively switches a conveyance destination of the recording medium between the reversing path and the ejecting path is disposed.

Accordingly, the paper sheet both sides of which are to be coated with the treatment liquid can be conveyed to the reversing path such as the coating reverse conveying path 203.

(Sixth Aspect)

The coating apparatus according to any one of the third to fifth aspects, further includes: a remaining sheet ejection portion such as a paper discharge purge 207 that ejects the recording medium such as the paper sheet remaining in a recording medium conveying path at the time of occurrence of a paper jam.

Accordingly, as described above with reference to FIG. 11, it becomes unnecessary to remove the recording medium remaining in the recording medium conveying path at the time of occurrence of the paper jam, whereby the workload of an operator for dealing with the paper jam can be suppressed.

(Seventh Aspect)

In the coating apparatus according to the sixth aspect, the recording medium remaining in the recording medium conveying path from the sheet feeder 100 to a branch point branching into the reversing path such as the coating reverse conveying path 203 and an ejecting path such as the coating sheet ejection path 206 that conveys the recording medium to the ejector, and the recording medium remaining in the reversing path are ejected to the remaining sheet ejection portion such as the paper discharge purge 207.

Accordingly, as described above with reference to FIG. 11, it becomes possible to shorten the time required for dealing with the remaining sheets and to advance the recovery from the paper jam compared with the case where the recording medium remaining in the recording medium conveying path of the coating apparatus and the recording medium remaining in the recording medium conveying path of the sheet feeder are conveyed to a sheet conveyer of the image forming apparatus and are ejected.

(Eighth Aspect)

In the coating apparatus according to the sixth or seventh aspect, the recording media on which a double feed is detected in the sheet feeder 100 (double-fed sheets) are conveyed to the remaining sheets ejector such as the paper discharge purge 207 without via the coater such as the coater 210.

Accordingly, as described above with reference to FIG. 12, the recording media (double-fed sheets) on which the double feed is detected in the sheet feeder 100 are conveyed to the remaining sheet ejection portion such as the paper discharge purge 207, whereby it is possible to easily deal with the double-fed sheets.

Further, since the double-fed sheets do not pass through the coater, the double-fed sheets do not wind around the coating roller or the like serving as the coater so that a malfunction such as a paper jam does not occur and the double-fed sheets can be conveyed to the remaining sheet ejection portion such as the paper discharge purge 207.

(Ninth Aspect)

An image forming system 1 includes: a sheet feeder 100; the coating apparatus 200 according to any one of the first to eighth aspects; and an image forming apparatus 300.

Accordingly, a favorable image in which bleeding of ink or the like is suppressed can be obtained.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

The invention claimed is:

1. A coating apparatus connectable to both an image forming apparatus with a first enclosure having an entrance and a sheet feeder with a second enclosure having an ejector, the coating apparatus comprising:

a coater to coat a recording medium with a treatment liquid;

a carry-in entrance on one of two exterior wall surfaces, the carry-in entrance to receive the recording medium from the sheet feeder; and an ejector on another of the two exterior wall surfaces, the ejector to eject the recording medium to the image forming apparatus, wherein a position of the carry-in entrance on the one of the exterior wall surfaces aligns with the ejector on said another of the exterior wall surfaces, aligns with the ejector of the second enclosure of the sheet feeder, and aligns with the entrance of the first enclosure of the image forming apparatus.

2. The coating apparatus according to claim 1, further comprising:

a first path to eject the recording medium to the image forming apparatus after the recording medium passes via the coater; and a second path to eject the recording medium to the image forming apparatus without the recording medium passing via the coater.

3. The coating apparatus according to claim 2, further comprising:

a reversing path to reverse the recording medium with a first surface coated with the treatment liquid and convey the recording medium to the coater.

4. The coating apparatus according to claim 3, wherein a length between the coater and a rear edge of a reversing portion of the reversing path is a length allowing a plurality of recording media to stay.

5. The coating apparatus according to claim 3, further comprising a switch to selectively switch a conveyance destination of the recording medium between the reversing path and the ejecting path, wherein the switch is disposed at a branch point branching into the reversing path and an ejecting path to convey the recording medium to the ejector.

6. The coating apparatus according to claim 3, further comprising a remaining sheet ejection portion to eject the recording medium remaining in a recording medium conveying path at a time of occurrence of a sheet jam.

7. The coating apparatus according to claim 6, wherein the recording medium remaining in the recording medium conveying path from the sheet feeder to a branch point branching into the reversing path and an ejecting path to convey the recording medium to the ejector, and the recording medium remaining in the reversing path are ejected to the remaining sheet ejection portion.

8. The coating apparatus according to claim 6, wherein the recording medium on which a double feed is detected in the sheet feeder is conveyed to the remaining sheet ejection portion without via the coater.

9. An image forming system comprising:

the sheet feeder;

the coating apparatus according to claim 1 connected to the sheet feeder; and the image forming apparatus connected to the coating apparatus.

* * * * *